US006163670A

United States Patent [19]

Gomi et al.

[11] Patent Number: 6,163,670

[45] Date of Patent: Dec. 19, 2000

[54] CHARGING DEVICE AND IMAGE FORMING APPARATUS

[75] Inventors: Fumiteru Gomi, Shizuoka-ken; Atsushi Takeda, Mishima; Kouichi Hashimoto, Numazu; Yoshiyuki Komiya, Mishima, all of Japan

[73] Assignee: Canon Kabushiki Kaisha, Tokyo, Japan

[21] Appl. No.: 09/128,626

[22] Filed: Aug. 4, 1998

[30] Foreign Application Priority Data

Aug. 4, 1997 [JP] Japan ..... 9-221945

[51] Int. Cl.[7] ..... G03G 15/02

[52] U.S. Cl. ..... 399/175

[58] Field of Search ..... 399/50, 168, 174, 399/175, 176; 361/225

[56] References Cited

U.S. PATENT DOCUMENTS

| | | | |
|---|---|---|---|
| 5,351,109 | 9/1994 | Haneda | 399/175 |
| 5,367,365 | 11/1994 | Haneda et al. | 399/174 |
| 5,426,489 | 6/1995 | Haneda et al. | 399/175 |
| 5,592,264 | 1/1997 | Shigeta et al. | 399/175 |
| 5,754,927 | 5/1998 | Ishiyama et al. | 399/176 |
| 5,822,659 | 10/1998 | Ishiyama | 399/175 |

FOREIGN PATENT DOCUMENTS

| | | |
|---|---|---|
| 6-3921 | 1/1994 | Japan . |
| 7-84439 | 3/1995 | Japan . |

*Primary Examiner*—Sandra Brase
*Attorney, Agent, or Firm*—Fitzpatrick, Cella, Harper & Scinto

[57] ABSTRACT

A charging apparatus includes a magnetic brush charging member for being supplied with a voltage to electrically charge a member to be charged, said charging member including a magnetic particle layer contactable to the member to be charged and a carrying member for carrying the magnetic particle layers, wherein said magnetic particle layer is moved along a peripheral surface of said carrying member; and stirring means, contactable to said magnetic particle layer carried by said carrying member, for stirring said magnetic particle layer in a longitudinal direction of said carrying member.

17 Claims, 8 Drawing Sheets

CHARGING DEVICE AND IMAGE FORMING APPARATUS

FIELD OF THE INVENTION AND RELATED ART

The present invention relates to a charging device of magnetic brush type for charging a member to be charged such as a photosensitive member or a dielectric member, and to an image forming apparatus using such a charging device for charging an image bearing member.

Referring first to FIG. 12, there is shown a conventional image forming apparatus in the form of a transfer type electraphotographic apparatus (copying machine, printer, facsimile machine).

Designated by 101 is an electrophotographic photosensitive member of a rotatable drum type as an image bearing member (photosensitive drum), which is rotatable in the clockwise direction indicated by the arrow at a predetermrined peripheral speed.

The photosensitive drum 101, during the rotation, is uniformly charged to a predetermined polarity and potential by a corona charger 102 (charging means), and then is exposed to light (image exposure L) by unshown image exposure means (projection imaging exposure means for an original image, laser beam scanning exposure or the like), by which the uniformly charged surface is selectively discharged (or the potential is attenuated selectively) correspondingly to the exposing image pattern, so that electrostatic latent image is formed. The formed electrostatic latent image thus formed is developed into a toner image by a toner developing device 103 as developing means.

On the other hand, a transfer material (transfer paper) P as a recording material is fed from an unshown sheet feeding mechanism to between the photosensitive drum 1 and the transfer corona charger 104 as a transferring means at a predetermined control timing, and the back side of the transfer material P charged to a polarity opposite from the toner, by which the toner image is electrostatically transferred onto the front side of the transfer material P from the surface of the photosensitive drum 101.

Then, the transfer material P is electrostatically separated from the surface of the rotatable photosensitive drum 101 by a separation corona charger 105, and is then introduced into a fixing device 108 by a feeding device 107, and is subjected to a fixing process so that toner image is fixed thereon. It is discharged as a print (copy, print).

The surface of the photosensitive drum 101 after the toner image transfer onto the transfer material P, is cleaned by cleaning means (cleaner) 106 so that untransferred toner is removed, so as to be prepared for the repeated image formation.

There are various structures and systems for the means for effecting the image formation process, such as the photosensitive member as the image bearing member, charging, exposure, development, transfer, fixing, cleaning or the like means.

1) for example, as the charging means 102, a corona charger has been widely used. In such means, a corona charger is disposed faced to the photosensitive drum without contact thereto, so that photosensitive drum surface is exposed to the corona emitted from the corona charger to charge the photosensitive drum surface to a predetermined polarity and potential.

Recently, a contact charging type charging device is put into practice since it is advantageous in the low ozone production, low electric power consumption or the like as compared with the non-contact type. In this system, a contact charging member supplied with a voltage is contacted to the photosensitive drum, so that photosensitive drum surface is charged to a predetermined polarity and potential.

A preferable example of the contact charging member may be a magnetic brush masher including a magnetic brush portion constituted by magnetically confining electroconductive magnetic particles, wherein the magnetic brush portion is contacted to the photosensitive drum ((magnetic brush charger)), since the contact is stable.

The magnetic brush portion of the magnetic brush member is provided by directly confining the electroconductive magnetic particles or by magnetically confining them on a sleeve enclosing a magnet.

Alternatively, electroconductive fibers may be formed into a brush (furbrush member), or an elctroconductive rubber is formed into a roller (electroconductive rubber roller (charging roller)).

Particularly, when the magnetic brush member is used as the contact charging member for a normal organic photosensitive member (member to be charged) having a surface layer in which electroconductive fine particles are dispersed (charge injection layer) or for an amorphous silicon photosensitive member, the photosensitive member surface is charged to a potential substantially equivalent to that of the DC component of the bias applied to the contact charging member (Japanese Laid-open Patent Application No. HEI-6-3921).

Such a charging method is called here "injection charging" (charging of the member to be charged by direct injection of the charge at the contact portion). The injection charging does not use the discharge phenomenon which has been used in the corona charger, so that complete ozoneless charging can be accomplished together with the low electric power consumption, and therefore, it is noted.

As for a toner developing method for an electrostatic latent image, there are many types which are classified into the following four types (a–d):

a. Non-magnetic toner is applied on a sleeve using a blade or the like, or a magnetic toner is applied on a sleeve by magnetic force, and is carried to a developing zone where it is faced to the photosensitive member without contact thereto (one component non-contact development).

b. The toner applied in the same manner is contacted to the photosensitive member (one component contact development).

c. A developer (two component developer) in the form of a mixture of toner particles and magnetic carrier particles is fed using magnetic force, and is contacted to the photosensitive member (two component contact development).

d. The two component developer is used, and is not contacted to the photosensitive member (two component non-contact type development).

Among them, the two component contact developing method (c) is widely used because of the high image quality and highly stability thereof.

3) Recently, such an image forming apparatus is downsized, but the downsizing of the image formation process means such as the charging, exposure, development, transfer, fixing, cleaning or the like means involves a limit from the standpoint of the downsizing of the entire image forming apparatus.

As described in the foregoing, the untransferred toner is removed from the photosensitive drum 101 after the image transfer, and is collected by the cleaner 106 as a residual toner. But, the amount of the residual toner is desirably small. Thus, image forming apparatuses capable of recycling toner have been developed. In such an image forming apparatus, a cleaner is eliminated, and the toner which remains an the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference V[−]back [−] between the level of the DC voltage applied to a developing apparatus and the level of the surface potential of a photosensitive member) during the following image transfer. According to this cleaning method, the residual toner is recovered by the developing apparatus and is used for the following image development and thereafter; the waste toner is eliminated. Therefore, the labor spent for maintenance is reduced. Further, being cleanerless is quite advantageous in terms of space, allowing image forming apparatuses to be substantially reduced in size.

In the simultaneous development and cleaning type, the toner having a high parting property such as the toner manufactured through a polymerization method for example is desirable from the standpoint of improving the cleaning efficiency.

4) As for the transferring means for transferring the toner image from the photosensitive drum 101 onto the transfer material P, use of transfer roller or transfer belt rather than the transfer corona charger 104 is possible.

The present invention relates to an image forming apparatus using a charging device of magnetic brush type, and an image forming apparatus using such a charging device for charging the image bearing member.

a) The contact charging device tends to be contaminated due to collection of contamination or foreign matter from the surface of the member to be charged in long tern operation. An excessive contamination of the contact charging member may results in deterioration of the charging power.

In the magnetic brush type charging device, the magnetic brush portion comprising fine electroconductive magnetic particles is contacted to the member to be charged, and therefore, it is advantageous in that contact property with the surface of the member to be charged is uniform, and in that it is relatively free of influence of contamination as compared with the other contact charging member such as the electroconductive rubber roller or fixed type or rotary type furbrush, but the excessive contamination with the foreign matter or contamination of the magnetic brush portion deteriorates the charging power.

b) In an image forming apparatus of transfer type wherein the contact charging device of the magnetic brush type is used for the charging means for the image bearing member, even if the cleaner exclusively for removing the untransferred toner from the image bearing member is used, the toner particles or the like are more or less carried over to the position ((charging nip) where the magnetic brush member is contacted to the image bearing member as a result of repetition of the image formation, and are deposited on the magnetic brush portion and accumulated therein with the result of contamination of the magnetic brush member The toner particle normally has a relatively high electric resistance. Therefore, if a relatively large amount of such toner particles are deposited or mixed into the magnetic brush portion of the magnetic brush member as the contact charging member and then are accumulated, the electric resistance of a part or entirety of the magnetic brush member rises, with the result of image defect due to incapability of charging the image bearing member to the desired potential or due to charging non-uniformity.

c) The toner contamination of magnetic brush member and the resulting occurrence of the image defect are particularly remarkable in a cleaner-less system image forming apparatus which is not provided with a cleaner exclusively for removing the untransferred toner from the image bearing member after the image transfer.

In the case of the cleaner-less system image forming apparatus, a relatively large amount of the untransferred toner on the image bearing member is carried over to the charging nip where the magnetic brush member is contacted to the image bearing member with the continuing movement of the image bearing member, by which a large amount thereof is deposited to and mixed into the magnetic brush portion, and therefore, the magnetic brush member tends to be contaminated with toner relatively quickly.

In the cleaner-less system image forming apparatus, the untransferred toner is distributed on the image bearing member in the form of a previous image pattern, and therefore, if it passed through the charging nip, the charged potential is low only in the previous image portion, or the image exposure is blocked only at such portions. This may influence the developing process with the possible result of low density only at such portions in the developed image (so-called ghost image phenomenon).

To avoid this, a proposal has been made to use a brush-like uniformalization member for uniform dispersion of the untransferred toner on the image bearing member before the untransferred toner in the form of the previous image pattern reaches the charging nip or to use a simple cleaning member using temporary bias effect. However, when an image having a high density is locally formed repeatedly, the resistance value of the magnetic brush portion rises only at the portion corresponding to the high density portion of the image. If this occurs, the entirety of the magnetic brush member has to be replaced by the partial deterioration despite the fact that other portion is usable (local contamination of the magnetic brush member).

SUMMARY OF THE INVENTION

Accordingly, it is a principal object of the present invention to provide a charging device and an image forming apparatus wherein a local contamination of a magnetic brush charging member is avoided to eliminate charging non-uniformity.

It is another object of the present invention to provide a charging device and an image forming apparatus wherein a service life of a magnetic brush charging member is expanded.

It is a further object of the present invention to provide an image forming apparatus wherein image defect attributable to charging non-uniformity of a magnetic brush charging member is avoided to accomplish satisfactory image formation for a long term with stability.

According to an aspect of the present invention, there is provided a charging apparatus comprising a magnetic brush charging member for being supplied with a voltage to electrically charge a member to be charged, said charging member including a magnetic particle layer contactable to the member to be charged and a carrying member for carrying the magnetic particle layers, wherein said magnetic particle layer is moved along a peripheral surface of said carrying member; stirring means, contactable to said magnetic particle layer carried by said carrying member, for stirring said magnetic particle layer in a longitudinal direction of said carrying member.

These and other objects, features and advantages of the present invention will become more apparent upon a consideration of the following description of the preferred embodiments of the present invention taken in conjunction with the accompanying drawings

DESCRIPTION OF THE PREFERRED EMBODIMENTS

(Embodiment 1)

(1) Structure of an Example of an Image Forming Apparatus

Figure 1:
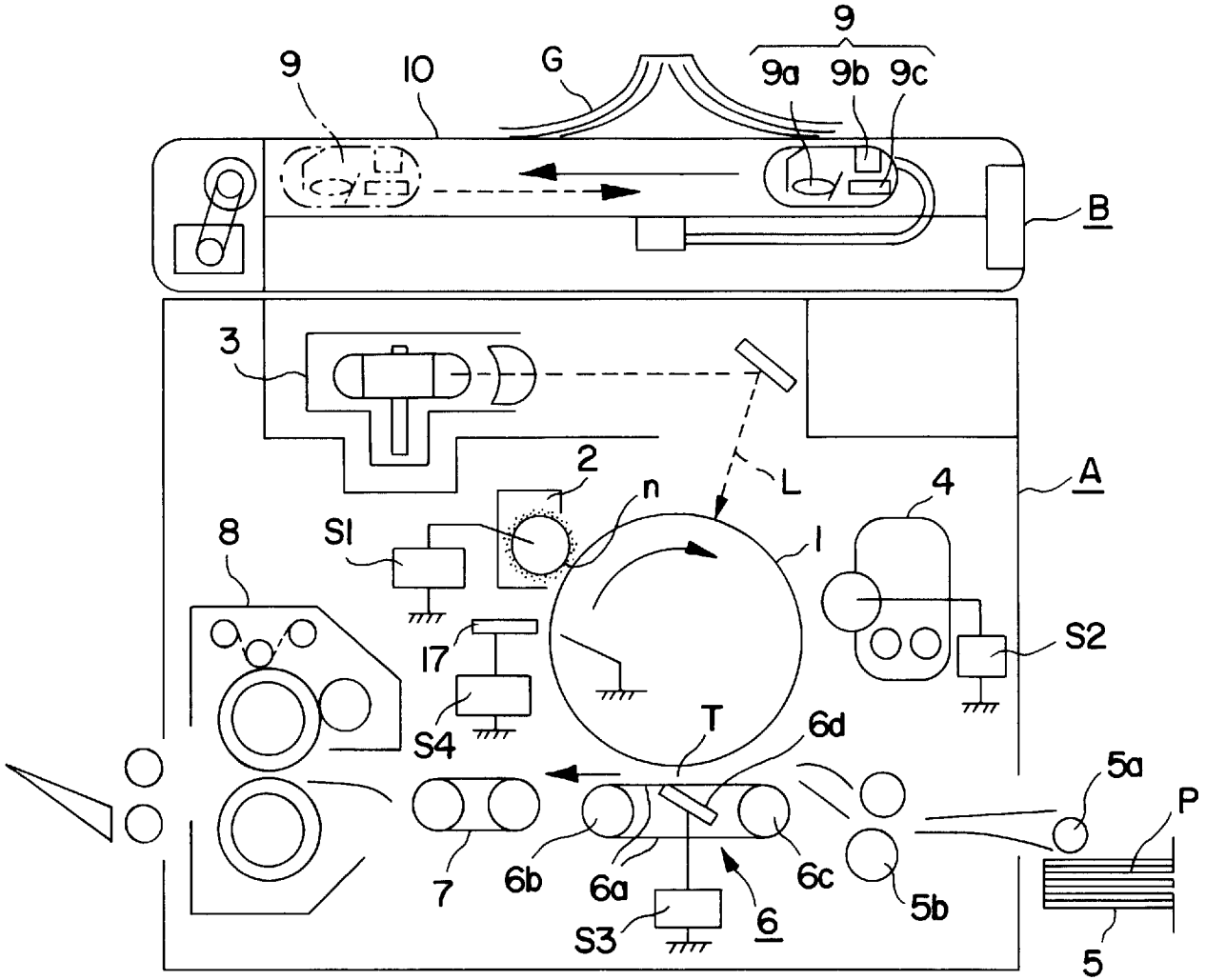
FIG. 1 is a schematic view of an image forming apparatus according to Embodiment 1.

FIG. 1 is a schematic view of an example of an image forming apparatus according to Embodiment 1 of the present the invention. The image forming apparatus of this embodiment is in the form of a laser beam printer using a transfer type electrophotographic process, and uses a contact charging device of magnetic brush type as a charging means for a photosensitive drum as an image bearing member, and it is a cleaner-less system image forming apparatus wherein a developing means effects simultaneous development and cleaning.

Designated by A is a laser beam printer, and B is an image reader or scanner for reading an image, placed on the printer.

a) Image Reading Apparatus B

In the image reading device B, designated by 10 is an original supporting platen glass fixed on the upper surface of the device, and an original G to be copied is placed face down on the top surface of the original supporting platen glass, and is covered by an unshown original cover it.

Designated by 9 is an image reading unit including an original illumination lamp 9*a*, a short focus lens array 9*b*. CCD sensor 9*c* and the like. The unit 9, upon actuation of an unshown copy key, is moved forward along a bottom surface of the glass from its home position at the right-hand portion, and upon arrival at a predetermined forward movement end portion, it is moved backward to the home position.

During the forward movement driving stroke of the unit 9, the image surface of the set original G on the original supporting platen glass 10 is illuminated and scanned from the right-hand side to the left-hand side by the original projection lamp 9*a* of the unit 9, and the light reflected by the surface of the original is imaged an a CCD sensor 9*c* by the short focus lens array 9*b*.

CCD sensor 9*c* includes a light receiving portion a, transfer portion and an output portion. A light signal is converted to a charge signal by the light receiving CCD portion, and the charge signal is transferred to an output portion in synchronization with clock pulses by a transfer portion. In the output portion, the charge signal is converted to a voltage signal, which is then amplified with impedance reduction treatment, and the resultant signal is outputted. The analog signal provided in this manner, is subjected to a known image processing, so that digital signal is produced and is fed to the printer A.

Namely, the image reading device B carries out photoelectric reading of the image information of the original G and conversion thereof to a time series electrical digital pixel signal (image signal).

b) Printer A

In the printer A, designated by 1 is an electraphotographic photosensitive member (photosensitive drum) of a rotatable drum type as an image bearing member. The photosensitive drum 1 of this example is an OPC photosensitive member including a charge injection layer. The photosensitive member 1 will be described in detail hereinafter (2).

The photosensitive drum 1 is rotated about a center supporting shaft in the clockwise direction indicated by an arrow at a predetermined peripheral speed (peripheral speed of 100 mm/sec in this embodiment), and during the rotation, it is charged to a negative potential, in this embodiment, to approx—700V by charging means 2. In this Embodiment, the charging means 2 is a contact charging device of a magnetic brush type. The charging device 2 will be described in detail hereinafter (3).

The thus charged surface of the photosensitive member 1 is exposed to and scanned by a laser scanner 3 having an intensity modulated in accordance with image signal fed to the printer A from the image reading device B, corresponding to the intended image information, so that electrostatic latent image thereof is formed in accordance with the image signal. The laser scanner 3 will be described in detail hereinafter (4).

The formed electrostatic latent image on the surface of the rotatable photosensitive drum 1 is developed sequentially into a toner image by the developing device 4. In this embodiment, a reverse development system is used. In this embodiment, the developing device 4 uses two-component contact type developing system. The developing device 4 will be described in detail hereinafter (5).

On the other hand, a recording material (transfer material) P accommodated in a sheet feeding cassette 5 is, fed out by sheet feeding rollers 5*a* one by one, and is fed into the printer A. It is fed to the transfer portion T in the form of a contact nip between the photosensitive drum 1 and a transfer belt 6 as a transferring means at a predetermined controlled timing by registration rollers 5*b*.

The toner image is electrostatically transferred onto the surface of the transfer material P fed to the transfer portion T, from the surface of the rotating photosensitive drum by a transfer charging blade 6*d* disposed inside the transfer belt 6. The transferring device 6 will be described in detail hereinafter (6).

The transfer material P having received the toner image at the transfer portion T, is sequentially separated from the surface of the photosensitive drum 1, and is fed along a feeding device 7 to a fixing device 8, where the toner image is subjected to heat fixing, and the transfer material P is discharged as a copy or a print.

Since the printer of this example is a cleaner-less system apparatus, there is not provided a cleaning device (cleaner) exclusively for collecting the untransferred toner remaining on the surface of the rotating photosensitive drum after the transfer material separation, the untransferred toner on the surface of the rotatable photosensitive drum 1 is removed by the developing device 4 through simultaneous development and cleaning operation to prepare the surface of the rotatable photosensitive drum 1 for the repetition of image forming operation.

Designated by 17 is a metal plate disposed adjacent to the photosensitive drum 1 between the transfer portion T formed between the photosensitive drum 1 and the transferring device 6 and the charging nip n of the charging device 2, and functions to charge (or discharge) the untransferred toner to an opposite polarity (positive) from the regular charge polarity (negative, in this example). This will be described in detail hereinafter (7).

Figure 2:
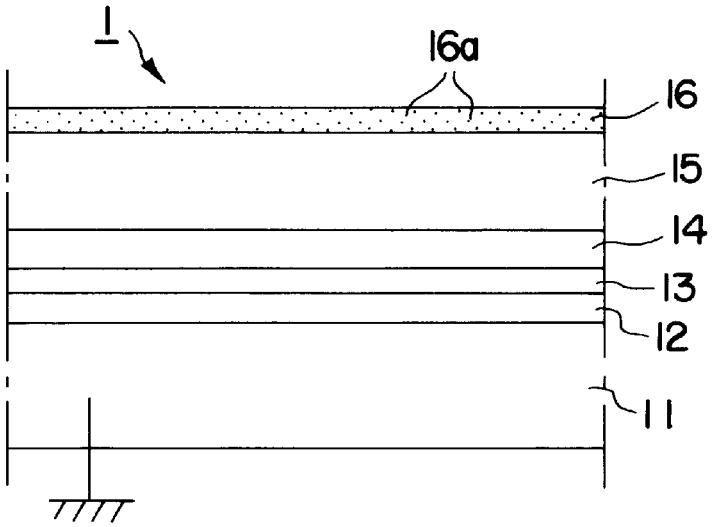
FIG. 2 shows a schematic layer structure a photosensitive drum as an image bearing member.

(2) A Photosensitive Drum (FIG. 2)

The photosensitive drum (photosensitive member) 1 as the image bearing member may be an organic photosensitive member or the like which is usually used. Other usable members are photosensitive members using CdS, Si, Se or another inorganic semiconductor. Desirably, it has a surface layer of a material having a volume resistivity of $10^9$–$10^{14}$ Ωcm on an organic photosensitive member, or it is an amorphous silicon photosensitive member or amorphous selenium photosensitive member, since the charge injection charging can be used with the advantages of low ozone production and low electric power consumption. The charging property may also be improved.

The photosensitive drum 1 used in this example is a negatively chargeable organic photosensitive member having a surface charge injection layer, and comprises a drum base (aluminum base) of aluminum having a diameter of 30 mm, and following first to fifth layers thereon. FIG. 2 is a schematic view of the layers.

First layer 12: primer layer in the form of an electroconductive layer having a thickness of 20 μm, provided to uniform the aluminum base 11.

Second layer 13: positive charge injection preventing layer in the form of intermediate resistance layer having a thickness of 1 μm and having a volume resistivity of approx $1\times10^6$ Ωcm adjusted by AMILAN (tradename of polyamide resin material, available from Toray Kabushiki Kaisha, Japan) resin material and methoxymethyl nylon, provided to prevent cancellation of the negative charge on the photosensitive member surface by the positive charge injected from the aluminum base 11.

Third layer 14: charge generating layer of resin material in which disazo pigment is dispersed, having a thickness of approx 0.3 μm. This layer generates a couple of positive and negative charges upon exposure to light.

Fourth layer 15: charge transfer layer of polycarbonate resin material in which hydrazone is dispersed. This layer is a P-type semiconductor. Therefore, the negative charge on the photosensitive member surface cannot move through this layer, and only the positive charge generated in the charge generating layer 14 can be transferred onto the photosensitive member surface.

Fifth layer 16: electronic injection layer which is a coating layer of insulative resin material binder in which $SnO_2$ ultra-fine particles are dispersed as electroconductive particles 16*a*. More particularly, 70% by wt. (on the basis of the resin material) of $SnO_2$ particles which has a particle size of approx 0.03 μm and a resistance of which is lowered ((or made electroconductive) by doping antimony which is a light permeable insulation filler, is dispersed in the insulative resin material.

Such coating liquid is applied into a thickness of approx 3 μm through a proper coating method such as dip coating method, spray coating method, roller coating method, beam coating method or the like, thus providing a charge injection layer.

Figure 4:
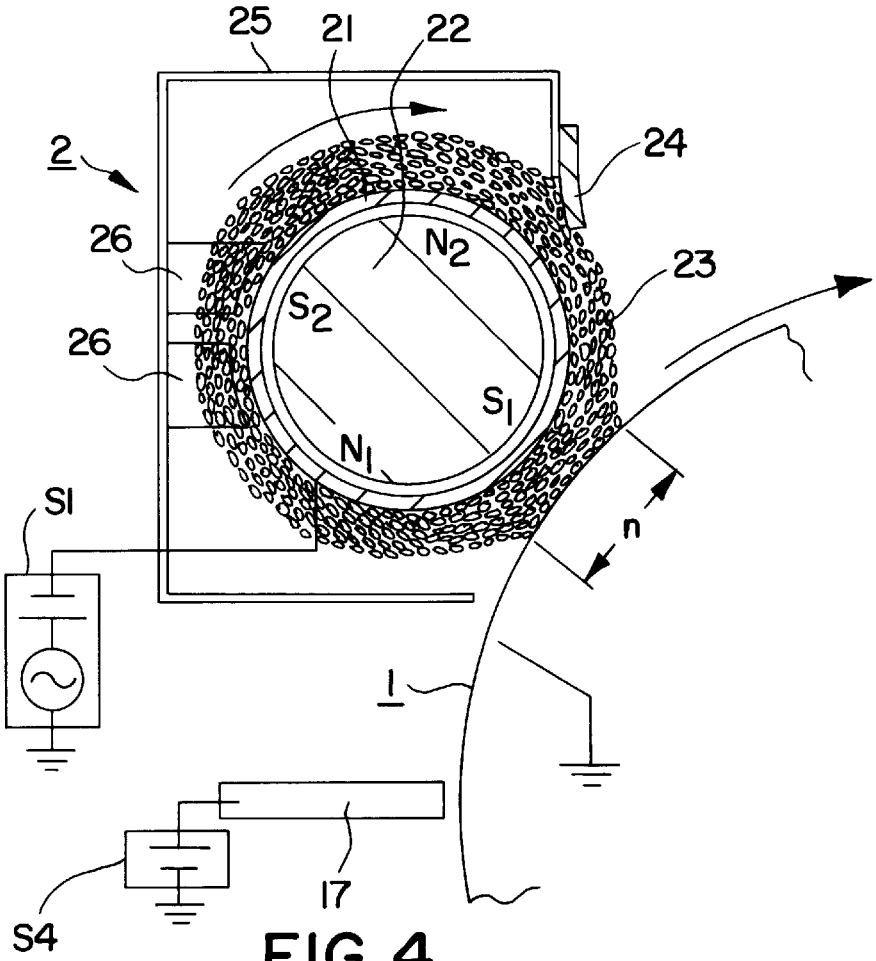
FIG. 4 is a schematic view of a contact charging device of magnetic brush type.
Figure 5:
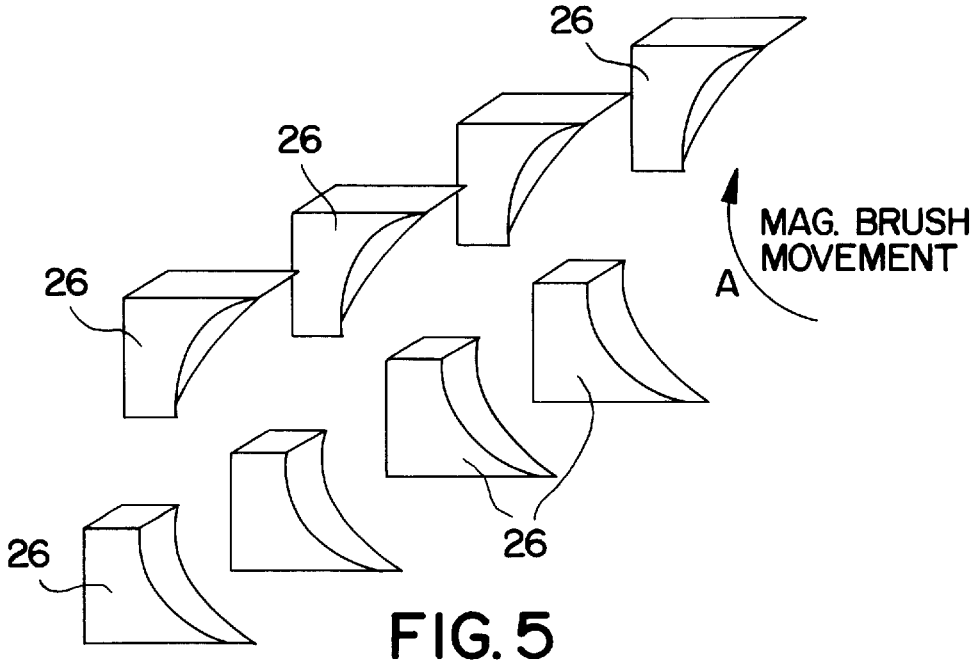
FIG. 5 is a perspective view of a magnetic particle stirring member in a magnetic brush portion.
Figure 6:
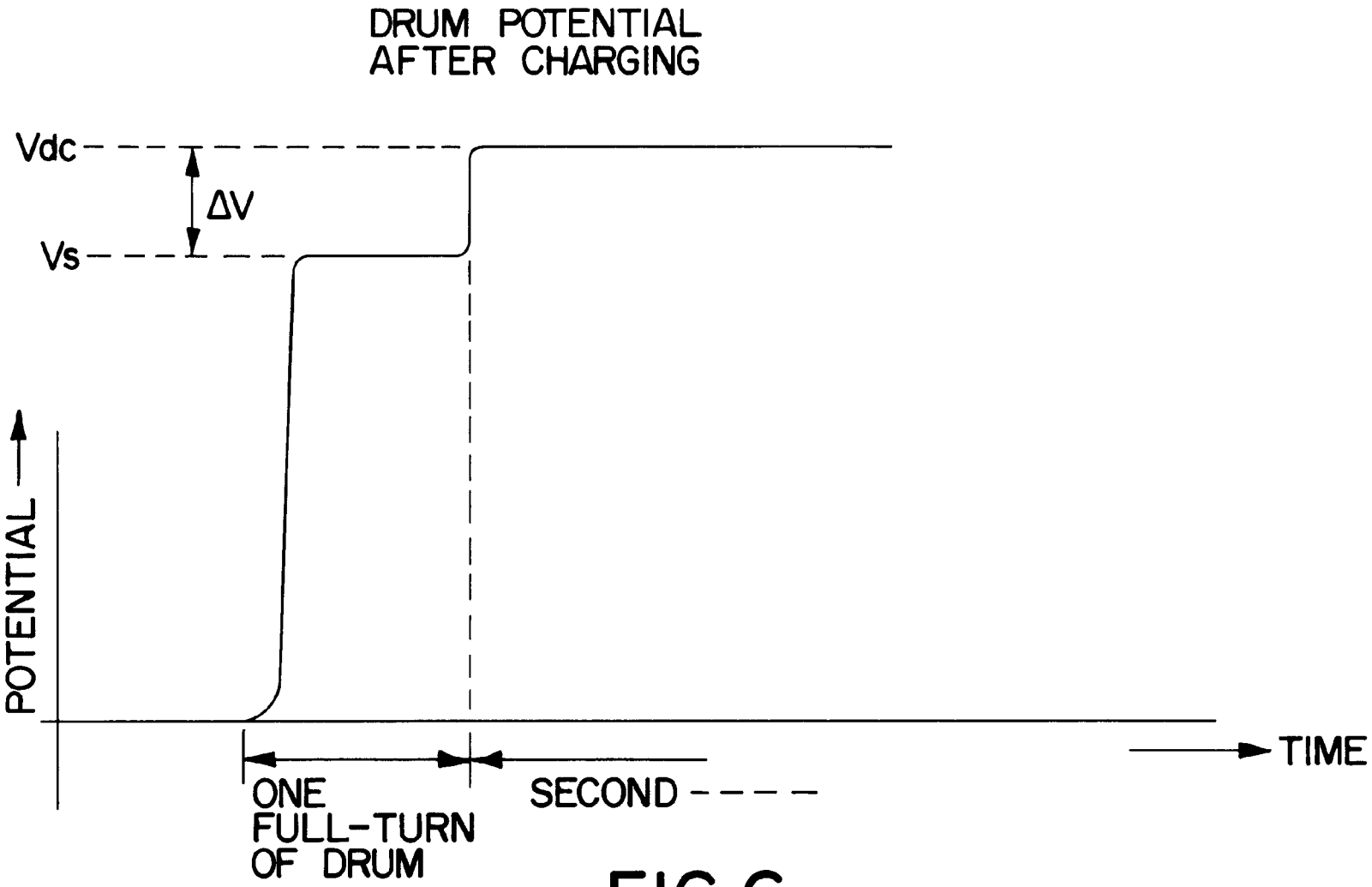
FIG. 6 is a graph of an amplitude of an applied bias vs. Charged potential after one full-turn when a rectangular alternating voltage of 1000 Hz is applied to a magnetic brush member.

(3) Charging Device 2 (FIGS. 4–6)

In this example, the charging device 2 is a magnetic brush type contact charging device. FIG. 4 is a schematic view thereof.

Designated by 21 is a rotatable sleeve (charging sleeve) as a carrying member for the magnetic brush of the electroconductive magnetic particles. The sleeve 21 in this example is a non-magnetic sleeve having an outer diameter of 16 mm, and functions also as an electric energy supply electrode. It is of aluminum. It is rotatably supported at the opposite end sides in an apparatus casing (charging container) 25. The front side of the sleeve 21 is exposed to outside through the front side opening of the apparatus casing 25.

Designated by 22 is a magnet roller as a magnetic field generating member disposed in the sleeve 21 substantially concentrically with the sleeve 21. In this example, it is a magnet roller having four magnetic poles, and is not rotatable.

The sleeve 21 is rotated in the clockwise direction indicated by an arrow which is counterdirectional against the photosensitive drum 1 at the charging nip by an unshown driving system around the stationary magnet roller 22. In this embodiment, the rotational speed of the photosensitive drum 1 is such that peripheral speed thereof is 100 mm/sec, and the sleeve 21 is rotated at a peripheral speed of 150 mm/sec.

Designated by 23 is a magnetic brush portion of electroconductive magnetic particles (magnetic particles) or the magnetic particles, which are magnetically confined by the magnetic force of the magnet roller 22 in the sleeve an the outer surface of the sleeve 21.

Designated by 24 is a regulating plate as a regulating means for regulating an amount of the carried magnetic particles on the sleeve 21. In this example, the regulating plate 24 is a non-magnetic rigid blade member. The regulating plate 24 is securely fixed on the front side wall adjacent the upper edge of the front side opening of the apparatus casing 25 with a predetermined gap between the bottom edge of the regulating plate and the outer surface of the sleeve 21.

The sleeve portion exposed through the front side opening of the apparatus casing 25 and the photosensitive drum 1 are opposed to each other with a predetermined gap (at the position where they are closest) therebetween. In this example, the nip width of the charging nip n where the magnetic brush portion 23 is contacted to the photosensitive drum 1 is approx 6 mm.

The magnetic particles 23 deposited on the outer surface of the sleeve 21 by the magnetic confinement, are carried thereon by the clockwise direction rotation of the sleeve 21 in the same direction. They are formed into a magnetic brush having a regulated layer thickness on the sleeve 21 by passing through the gap between the lower edge of the regulating plate 24 and the outer surface of the sleeve 21. The magnetic brush is fed into the charging nip n, and the surface of the rotatable photosensitive drum 1 is rubbed with the magnetic brush portion 23 of the magnetic particles.

The magnetic particles pass through the gap of the charging nip n are kept on the sleeve 21 by the magnetic confinement and is returned into the apparatus casing 23 by the continuing rotation of the sleeve 21, and are reused (circulation).

The magnetic brush portion 23 is supplied with a predetermined charging bias voltage from a charging bias applying voltage source S1 through the sleeve 21, and the surface of the rotatable photosensitive drum 1 is charged to a predetermined polarity and potential by the rubbing by the magnetic brush portion 23 of the magnetic particles and by the applied charging bias voltage, at the charging nip n.

a) Applied Charging Bias

FIG. 6 shows an amplitude of the applied bias vs. The charged potential level after one full-turn when the applied charging bias is a rectangular alternating voltage of 1000 Hz.

When the amplitude is increased, the difference between the DC component at the applied bias and the charged potential decreases. More particularly, it is assumed that DC component of the bias applied to the charging device is Vdc, and the surface potential of the charged photosensitive drum 1 is Vs, the uniformity of the charging is satisfactory when the difference &LD&V=Vdc−Vs is not more than approx 40V.

Accordingly, in this example:

DC voltage: −700V

Alternating voltage: rectangular waveform having an amplitude of 800V (Vpp) and a frequency Vf 1000 Hz are superimposed to provide the bias voltage, and satisfactory charging properties were provided.

In this example, as described hereinbefore, the photosensitive drum 1 is provided with a charge injection layer 16 at its surface, and therefore, the photosensitive drum 1 is charged through charge injection charging. More particularly, by applying a predetermined charging bias voltage to the sleeve 21, the charge is given to the photosensitive drum 1 from the magnetic particles constituting the magnetic brush portion 23, by which the surface of the photosensitive drum 1 is charged to a potential corresponding the charging bias voltage, substantially −700V in this example corresponding to the DC bias component of the applied charging bias, through injection charging.

By the application of the alternating electric field across the charging nip, the charging power is improved, and the positive ghost image is suppressed. With the increase of the rotational speed of the sleeve 21, the uniform charging tends to become better.

b) Magnetic Particle

The charging magnetic particle constituting the magnetic brush portion 23 desirably has an average particle size of 10–100 $\mu$m, a saturation magnetization of 20–25 emu/cm$^3$, and a volume resistivity of $1\times10^{2-1\times10}10$ Ωcm. In view of the fact that photosensitive drum 1 may have an insulation defect such as a pin hole, the resistance is desirably not less than $1\times10^6$ Ωcm. In order to improve the charging property, the resistance is preferably small, and therefore, the magnetic particle in this embodiment has an average particle size of 25 $\mu$m, a 200 emu/cm$^3$ and a resistance of $5\times10^6$ Ωcm.

The resistance value of the magnetic particles is measured in the following manner: 2 g of the magnetic particles is placed in a metal cell having a bottom surface area of 228 mm$^2$ to which a voltage is applied, and the current is measured when a voltage of 100V is applied.

The average particle size of the magnetic particles, is indicated by a maximum angular distance in the horizontal direction. More than 300 particles are randomly extracted using an optical microscope, and diameters thereof are measured, and the measurements are averaged.

For the magnetic property measurement of the magnetic particle, a DC magnetization B-H property automatic recording device BH-50, available from Riken Denshi Kabushiki Kaisha, is usable. The particles are filled into a cylindrical container having a diameter (inner diameter) 6.5 mm and height 10 mm, at approx 2 g, and motion of the particles in the container is prevented. The saturation magnetization is measured from the B-H curve.

The magnetic particle may be, for example, a resin material carrier comprising a resin material in which magnetite is dispersed as a magnetic material and in which carbon black is dispersed for electroconductivity and for resistance adjustment, or magnetite alone such as ferrite or the like having an oxidized or deoxidized surface for resistance adjustment, or magnetite alone such as ferrite or the like having a surface coated with resin material for resistance adjustment.

c) Charge Injection Charging

Figure 3:
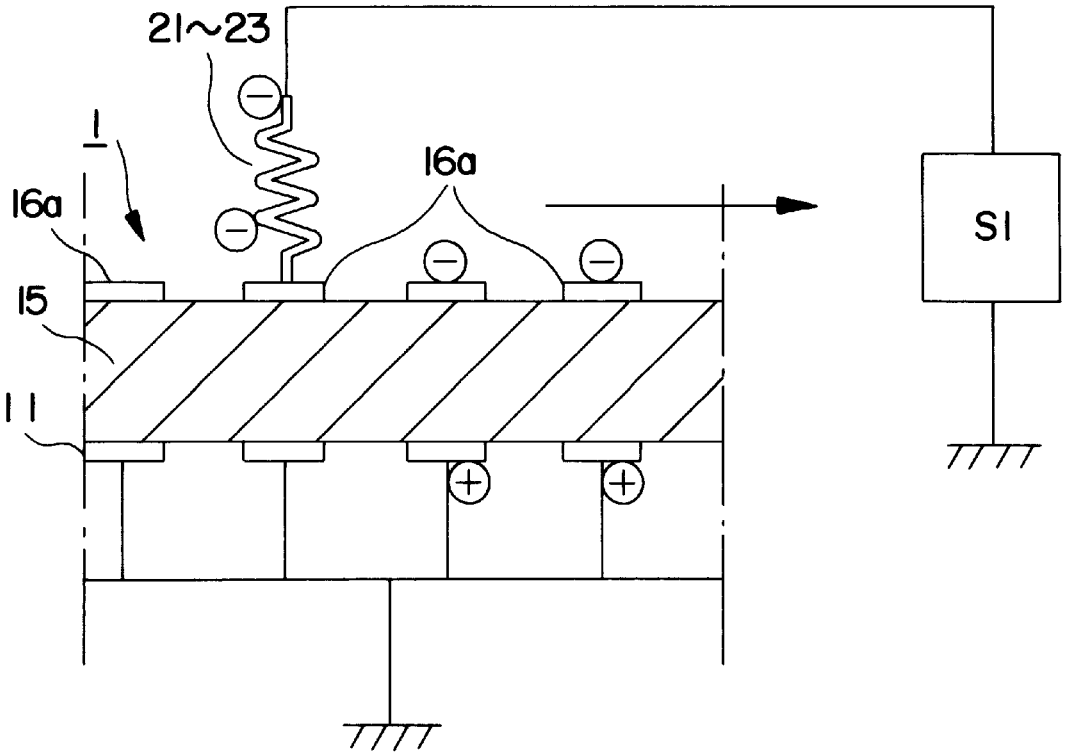
FIG. 3 is an equivalent circuit diagram of a photosensitive drum including a charge injection layer and a magnetic brush member as a contact charging member (illustration of charge injection charging).

It is considered that in the charge injection charging, the charge injection is effected to the surface of the member to be charged (photosensitive drum) having an intermediate surface resistance by the intermediate resistance contact charging member; and in this embodiment, the charge injection charging is not the one wherein the charge is injected into the trap potential of the surface material of the photosensitive drum, but electroconductive particles ($SnO_2$) **16*a* of the charge injection layer 16 is electrically charged to effect the charging; and as shown in the equivalent circuit diagram of FIG. 3, a fine capacitor constituted by charge transfer layer 15 as a dielectric member and the aluminum drum base 11 and the electroconductive particles 16*a* in the charge injection layer 16** as the opposite electrode plates, is electrically charged.

At this time, the electroconductive particles **16*a* are electrically independent, and constitute a sort of fine float electrodes. Macroscopically, therefore, the photosensitive drum surface seems to be charged to a uniform potential. Actually, however, a great number of fine charged electroconductive particles of $SnO_2$ covers the photosensitive drum surface. It is considered that since the $SnO_2$ particles 16*a*** are electrically independent from each other, the electrostatic latent image can be maintained despite the image exposure L using the laser beam.

d) Magnetic Particle Stirring Member

Designated by 26 is a member for stirring the electroconductive magnetic particles of the magnetic brush portion 23 which are fed and circulated while being confined magnetically on the sleeve 21 as the magnetic brush carrying member, and is in the form of projections contacted to and extended into the magnetic brush portion 23.

In this embodiment, the projections 26 (the magnetic particle stirring member) are fixed to or formed integrally with the internal wall surface of the apparatus casing (charging container) 25 of the charging device 2, and are staggeredly arranged substantially at regular intervals in a direction perpendicular to the feeding direction of the magnetic brush portion 23 (longitudinal direction of the sleeve 21) and are opposed close to the sleeve 21, as shown in FIG. 5. The free end portions of the projections 26 are in the magnetic brush portion 23 magnetically confined on the outer surface of the sleeve 21.

Each of the projections 26, as shown in FIG. 5, has a width, measured in a direction (longitudinal direction of the sleeve 21) perpendicular to the feeding direction of the magnetic brush portion 23, which increases toward the downstream with respect to the feeding direction of the magnetic brush portion 23, like a prow of a boat.

With the rotation of the sleeve 21, the magnetic brush portion 23 circulated while being confined magnetically on the outer surface of the sleeve, is branched by the prow-like portions of the projections 26 which are in the magnetic brush portion 23, and is further branched by the downstream projections 26, by which the electroconductive magnetic particles of the magnetic brush portion 23 are subjected to the stirring function in the longitudinal direction of the sleeve. By the stirring function, the contamination or foreign matter which are localized in the magnetic brush portion 23 is distributed to the other portion of the magnetic brush portion.

Figure 7:
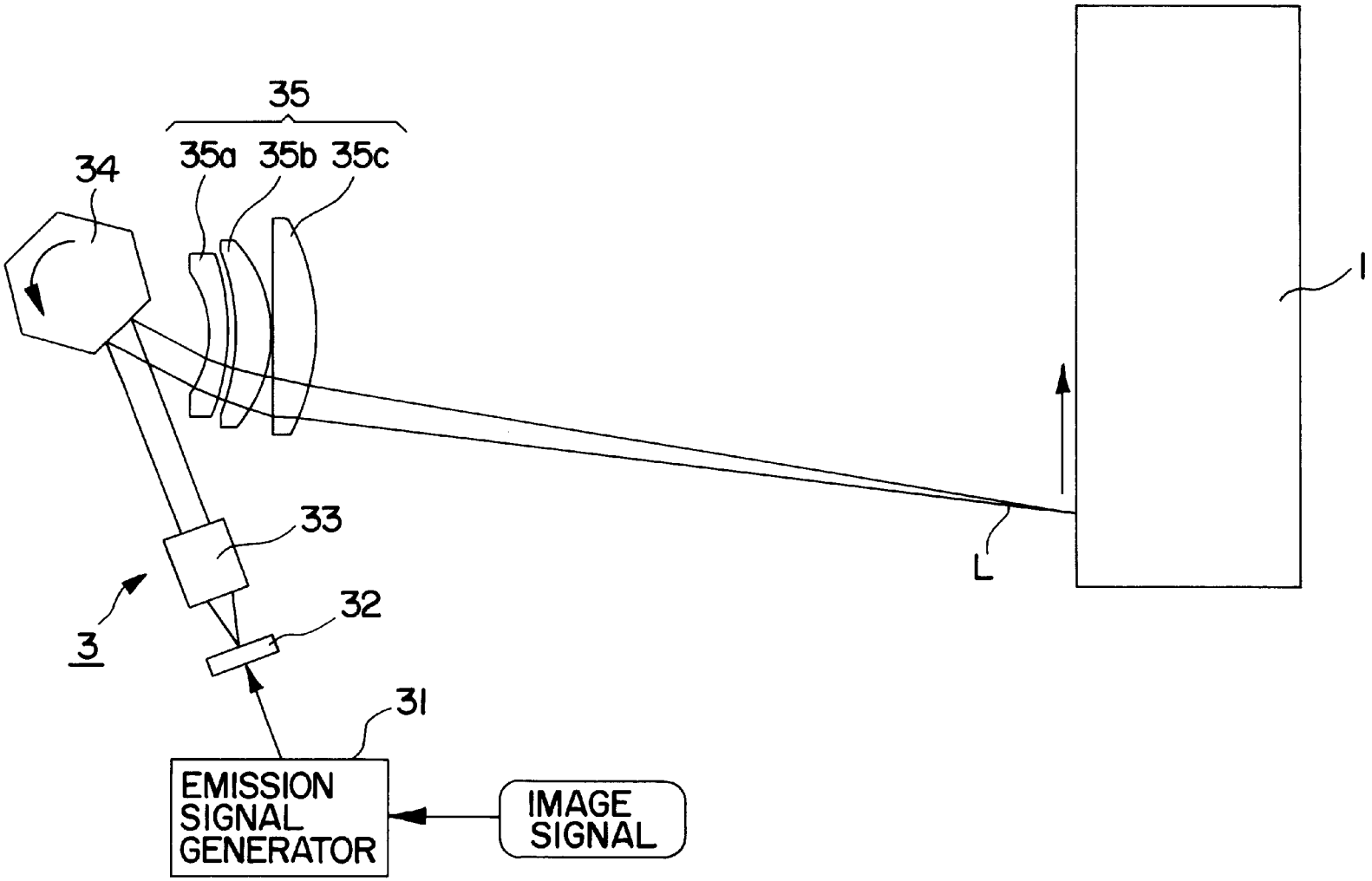
FIG. 7 is a schematic view of a laser scanner (laser scanner).

(4) Laser Scanner 3 (FIG. 7)

FIG. 7 shows a schematic structure of the laser scanner 3. When the laser scanner 3 effects the laser scanning exposure L on the surface to be scanned 1 (rotatable photosensitive drum surface), a solid laser element 32 is turned on and off at predetermined timing by a light emission signal generator 31 in accordance with an inputted image signal. The laser beam emitted from the solid laser element 32 is collimated by a collimator lens system 33, and is deflected by a rotatable polygonal mirror 34 in the direction indicated by the arrow which is rotating at a high speed in the counterclockwise direction indicated by the arrow, and then is imaged on the surface to be scanned 1 as a spot by fθ lens group 35 (35*a*, 35*b*, 35*c*).

By the laser beam scanning, an exposure distribution corresponding to one scan is formed on the surface to be scanned 1, and by scrolling the surface to be scanned 1 in the direction perpendicular to the scanning direction through a predetermined distance for each scanning, an exposure distribution corresponding to the image signal is formed on the surface to be scanned 1.

Figure 8:
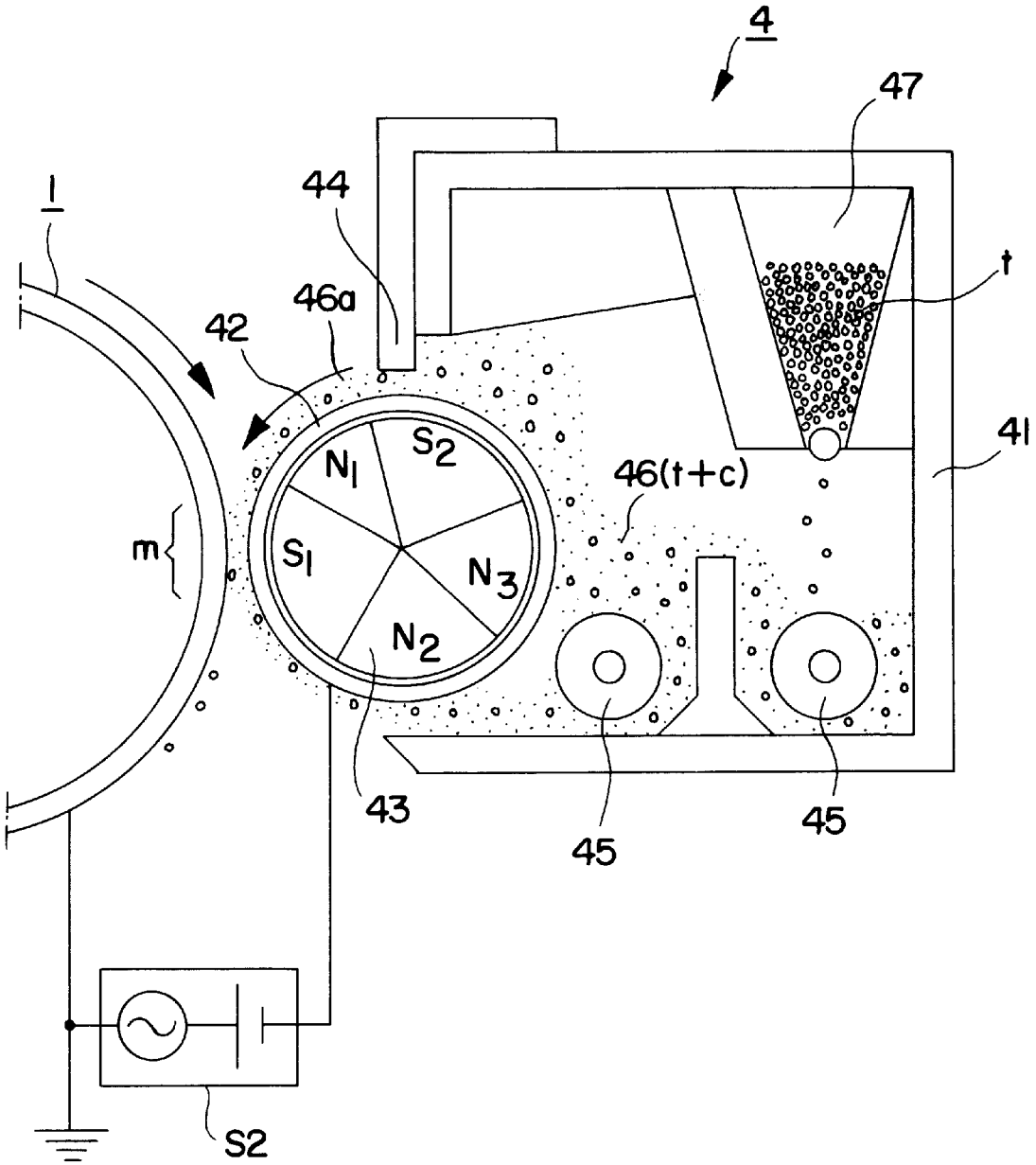
FIG. 8 is a schematic view of a developing device.

(5) Developing Device 4 (FIG. 8)

FIG. 8 shows a schematic structure of the developing device 4. The developing device 4 uses, as the developer, a mixture of non-magnetic toner particles and magnetic carrier particles, and the developer is carried on the developer carrying member in the form of a magnetic brush layer by magnetic force to the developing zone, where the magnetic brush layer is contacted to the surface of the photosensitive drum 1 to develop the electrostatic latent image into a toner image (two component magnetic brush contact developing system). The two component magnetic brush contact developing device is particularly suitable in an image forming apparatus using the cleaner-less system wherein the remaining toner is collected from the photosensitive drum 1 surface.

Designated by 41 is a developing container; 42 is a developing sleeve as the developer carrying member; 43 is a magnet roller as a magnetic field generating means stationarily fixed in the developing sleeve 42; 44 is a developer layer thickness regulating blade for forming a thin layer of the developer on developing sleeve surface; 45 is a developer stirring and feeding screw; 46 is the two component developer accommodated in the developing container 41, which comprises non-magnetic toner particles t and magnetic carrier particles c mixed therewith.

The developing sleeve 42 is so disposed that at least at the time of the development operation, it is placed with the closest distance from the photosensitive drum 1 being approx 500 μm. So that magnetic developer brush thin layer 46*a* on the outer surface of the developing sleeve 42 is contacted to the surface of the photosensitive drum 1. The contact portion between the magnetic developer brush layer 46*a* and the photosensitive drum 1 is a developing zone (developing portion).

The developing sleeve 42 is rotated around the stationary magnet roller 43 in the counterclockwise direction indicated by the arrow at a predetermined rotational speed. In the developing container 41, a magnetic brush of the developer 46 is formed on the outer surface of the sleeve by the magnetic force of the magnet roller 43. The magnetic developer brush is fed with the rotation of the sleeve 42, and is subjected to layer thickness regulation by the blade 44 so as to be a magnetic developer brush thin layer 46*a* having a predetermined layer thickness, and is carried out of the developing container to the developing zone. It is contacted to the surface of the photosensitive drum 1, and is returned into the developing container 41 by the continuing rotation of the sleeve 42.

With the rotation of the developing sleeve 42, the developer 46 is taken by the N3 pole of the magnet roller 43, and is conveyed by the S2 pole–N1 pole, during which it is regulated by the regulating blade 44 disposed perpendicularly relative to the developing sleeve 42, so that thin layer 46*a* of the developer 46 is formed on the developing sleeve 42. The developer layer 46*a* in the form of a thin layer is conveyed to the main developing pole S1 position in the developing zone, and is erected into chains of the developer by the magnetic force thereof. By the developer layer 46*a* in the form of chains, the electrostatic latent image on the photosensitive drum 1 is developed into a toner image, and thereafter, by the repelling magnetic field formed between the thereafter N3 pole and the N2 pole, the developer on the developing sleeve 42 is returned into the developing container 41.

Between the developing sleeve 42 and the electroconductive drum base of the photosensitive drum 1, a developing bias in the form of a DC voltage plus alternating voltage, is applied from a developing bias applying voltage source S2.

In this example, the developing bias voltage is as follows:

DC voltage: −500V

Alternating voltage: amplitude Vpp=1500V, and frequency Vf=2000 Hz

Such a developing bias is applied, so that negative charged toner t in the thin layer of the magnetic developer brush 46*a* on the developing sleeve 42 in the developing zone is selectively deposited on the electrostatic latent image on the photosensitive drum 1 so that electrostatic latent image is developed into the toner image (reverse development).

Generally, in the two-component developer type developing method, the alternating voltage is applied to enhance the development efficiency and to improve the image quality, but the application of the alternating voltage tends to produce foggy background. Therefore, ordinarily, a potential difference is provided between the DC voltage applied to the developing device 4 and the surface potential (dark portion potential) of the photosensitive drum 1 to prevent the fog.

The potential difference is called fog preventing potential (Vback) which is effective to prevent deposition of the toner on the non-image region of the photosensitive drum 1 during the development. In the cleaner-less system, it is used to collect the untransferred toner. More particularly, even if the residual toner remains on the drum, a developing electric field for depositing the toner to the light potential portion of the drum and the cleaning electric field for collecting the toner onto the developing sleeve from the dark potential portion of the drum.

The toner content of the developer 46 in the developing container 41 (mixture ratio with the carrier) decreases by consumption for the development of the electrostatic latent image. The toner content of the developer 46 in the developing container 41 is detected by an unshown detecting means, and when it lowers beyond a predetermined tolerable lower limit content, the toner is supplied into the developer 46 in the developing container from an unshown toner supplying portion so that toner content of the developer 46 in the developing container 41 is kept within a predetermined tolerable range.

The two component developer used in this embodiment comprises:

Toner particle t: negative charge toner having an average particle size of 6 $\mu$m and manufactured through a pulverization method, to which 1% by wt. Of titanium oxide having an average particle size of 20 nm is externally added.

Carrier c: magnetic carrier having an average particle size of 35 $\mu$m and saturation magnetization of 205 emu/cm$^3$.

The toner and carrier were mixed at weight ratio of 6:94.

The volume average particle size of the toner is determined, for example, in the following manner.

A measuring apparatus is a Coulter counter TA-2 (product of Coulter Co., Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 microns in particle size is measured with the use of the aforementioned Coulter counter TA-2, the aperture of which is set at 100 microns, and the volumetric distribution of the toner particles is obtained. Finally, the volumetric average particle size of the toner particles is calculated from the thus obtained volumetric distribution of the toner particles.

(6) Transferring Device 6

The transferring device 6 (FIG. 1) in this example is in the form of a transfer belt type, as has been mentioned hereinbefore. Designated by 6*a* ia an endless transfer belt, and is stretched around the driving roller 6*b* and the follower roller 6*c*, and is rotated substantially at the game peripheral speed as the peripheral speed of the photosensitive drum 1 in the same peripheral movement direction. Designated by 6*d* is a transfer charging blade disposed inside the transfer belt 6*a*, and forms a transfer nip T by pressing the upper portion of the transfer belt 6*a* to the photosensitive drum 1, and a transfer bias is applied thereto from a transfer bias application voltage source S3 to charge it to the opposite polarity from the toner at the back side of the transfer material P. By this, the toner image is sequentially and electrostatically transferred from the rotatable drum 1 onto the surface of the transfer material P passing through the transfer portion T.

In this example, the belt 6*a* is of polyimide resin material and has a film thickness of 75 $\mu$m.

The material of the belt 6*a* is not limited to the polyimide resin material, and other usable materials includes plastic resin material materials such as polycarbonate resin material, polyethylene terephthalate resin material, polyvinylidene fluoride resin material, polyethylenenaphthalate, resin material, polyetheretherketone resin material. polyether sulfone resin material, polyurethane resin material, and fluorine resin, or silicon resin materials. As regards the thickness, it is not limited to 75 $\mu$m, but may range approx 25–2000 $\mu$m, preferably 50–150 $\mu$m.

The transfer charging blade 6*d* used in this embodiment has a resistance of $1\times10^5$–$1\times10^7$ Ω, and a thickness of 2 mm and a length of length of 306 mm. The transfer charging blade 6*d* is supplied with a bias of +15 $\mu$A under a constant-current-control to effect the image transfer.

(7) Cleaner-less system, prevention of ghost image production, and prevention of local toner contamination of magnetic brush portion.

After the toner image transfer, a residual toner remains on the surface of the photosensitive drum 1. When the untransferred toner is simply permitted to pass through the charging device portion, the above-described ghost image is produced. When the untransferred toner is simply passed under the magnetic brush portion 23 contacted to the photosensitive drum 1, the pattern of the previous image remains but does not scatter under the proper charging condition of the magnetic brush.

It is therefore desirable that untransferred toner reaching the charging nip (charging region) n with the rotation of the photosensitive drum 1, is taken into the magnetic brush portion 23 to extinguish the hysteresis of the previous image. With application of a DC voltage alone to the magnetic brush portion 23, the toner is not sufficiently taken into the magnetic brush portion. But with application of an AC voltage, the toner is relatively easily taken into the magnetic brush portion 23 by a vibration effect due to the electric field between the photosensitive drum 1 and the magnetic brush portion 23.

However, the toner taking into the magnetic brush portion 23 may be very difficulty, depending on the charge amount of the untransferred toner reached to the charging nip n. As long as the untransferred toner is electrically charged, the potential difference between the magnetic brush portion 23 and the photosensitive drum 1 and the mirror force between the toner and the photosensitive drum, are very much influential to the toner taking into the magnetic brush portion.

It is ideal that surface potential of the photosensitive drum 1 having passed through the charging nip n is equal to the applied voltage to the magnetic brush portion 23. Actually, however, the charging nip n has a width, and at the initial stage in the passing through the charging nip n, the charging may not be sufficient even if it reaches substantially to the some potential at last. Therefore, there is a potential difference between the magnetic brush portion 23 and the photosensitive drum 1. In this embodiment, the applied voltage Vdc to the magnetic brush portion 23 is −700V, and therefore, in the region where the surface potential of the photosensitive drum is lower than that in the initial stage of the charging nip passing, the positive charged toner of the untransferred toner is easily taken into the magnetic brush portion, but the negative charged toner is not. When the charge amount of the untransferred toner is extremely large, the mirror force relative to the photosensitive drum is so large that toner remains on the photosensitive drum.

Therefore, it is desirable that untransferred toner is charged to the positive polarity even if the toner is a negative charge toner. However, even if it is not charged to the positive polarity it can be scraped by the magnetic brush portion if the absolute value of the charge amount is small enough.

The untransferred toner is frequently charged to the opposite polarity by separation discharge or the like during the transfer operation, and the charge amount distribution of the untransferred toner is significantly different depending on the transferring current even if the transfer efficiency is the same. With long term use, the developer per se is deteriorated with the result of decrease of the transfer efficiency, and therefore, the ratio of the negative toner in the untransferred toner increases. It is therefore preferable to raise the transferring current or to use a means for charging the untransferred toner to the opposite polarity.

In this embodiment, a metal plate 17 is disposed between the transfer portion T and the charging nip n without contact thereto, and it is supplied with +500V bias voltage from a voltage source S4. The clearance between the metal plate 17 and the drum is 100–500 $\mu$m.

Since the metal plate 17 is supplied with the positive bias, the positive toner of the untransferred toner passing the position of the metal plate 17, passes, but the negative toner is temporarily caught by the surface of the metal plate, and is electrically discharged thereby and fed out to the photosensitive drum 1. At this time, without the application of the bias or the like for positively feeding out to the photosensitive drum 1, when the toner is accumulated on the surface of the metal plate, the amount thereof reaches a limit of retention, and the discharged toner is gradually returned to the photosensitive drum 1.

Therefore, the untransferred toner coming to the charging nip n is either the one charged to the opposite polarity (positive) from the regular charge polarity ((negative) or the one having been discharged down to low charge level, so that they are collected by the magnetic brush portion 23. At this time, the hysteresis of the previous image pattern of the untransferred toner is lost, and therefore, the direct factor of the ghost image production is removed.

If the untransferred toner remains charged to the positive polarity despite the fact that it is collected into the magnetic brush portion 23, it is not discharged out thereof because of the relation in the potential difference between the magnetic brush portion 23 and the photosensitive drum 1 as described hereinbefore, but accumulates in the magnetic brush portion 23. When an amount of the toner beyond a predetermined level, although the level is dependent on the resistance value of the toner, is mixed into the magnetic brush portion 23, the charging power decreases even with the application of an alternating voltage component.

Even if the toner is discharged to the photosensitive drum 1 from the magnetic brush portion 23 by the centrifugal force or the like, the toner, if it is not regularly charged toner (negative), is not collected by the developing device 4 in the non-image portion and therefore remains there.

Therefore, it is desirable that once the untransferred toner is taken into the magnetic brush portion 23, it is charged to the regular polarity (negative in this embodiment).

This can be accomplished by using the triboelectric series of the toner and the magnetic particle constituting the magnetic brush portion 23 wherein the toner is at the negative polarity side.

In this embodiment, use is made with the negative charged toner of polyester as the binder resin material and magnetite alone such as ferrite having a surface coated with resin material for resistance adjustment as the magnetic particle constituting the magnetic brush portion 23.

When the projections 26 as the magnetic particle stirring member are not provided in the charging device 2, such a magnetic brush portion as corresponds to a local high image ratio portion, is locally and excessively contaminated by the toner, with the result that charging property is remarkably deteriorated at the contaminated portion to such an extend that fog is produced there.

In this embodiment, however, the projections 26 are provided as the magnetic particle stirring member as shown in FIGS. 4, 5, the magnetic particles of the magnetic brush portion 23 and the introduced untransferred toner are branched during the circulation thereof. Further, they are branched by the downstream member 26, and therefore, the magnetic particles which otherwise remain at the same longitudinal position are distributed over the sleeve with certainty. In other words, the magnetic particles of the magnetic brush portion 23 are stirred In the longitudinal direction of the sleeve (the direction of the generating line). Therefore, even if a large amount of the untransferred toner is introduced locally into the magnetic brush portion 23, the local contamination and the resultant local deterioration of the charging power can be prevented.

When the magnetic pole in the sleeve for retaining and feeding the magnetic brush portion 23 on the sleeve 21 is right at the most downstream position of the stirring member 26, the magnetic particles receive highest load there, with the result that feeding is impeded by the magnetic force and therefore the require torque is increased. By disposing the stirring member between the repelling poles, the torque and the load can be decreased. Therefore, the magnetic pole in the sleeve is preferably not at the most downstream position of the sleeve of the stirring member.

Using such a structure, durability test was carried out for image formation from a black stripe pattern image of width of 5 cm.

With the conventional structure (without the magnetic particle stirring member 26), excessive local toner contamination of the magnetic brush portion 23 and the deterioration of the charging power occurred at the portion corresponding to the stripe image portion with the result of fog at the stripe portion or ghost image even if normal images were produced. after approx 2000 image formations.

With the structure of this embodiment (magnetic particle stirring member 26 was provided), each portion of the magnetic brush portion 23 continued the collection and discharge of the untransferred toner, without the excessive local toner contamination or deterioration of the charging power, so that good images were formed with stability for 100000 image formations.

The toner discharged onto the photosensitive member after being charged to the regular charge polarity by triboelectric charge with the magnetic particle or the like in the magnetic brush portion 23, was very uniformly distributed thereon, and the amount thereof was so small that it did not adversely affect the next image exposure process.

Substantially all of the toner having reached the developing zone ware charged to the regular charging polarity (negative). In the developing process, the toner deposited on the white background portion of the image (dark portion) is collected into the developing device 4 by the fog removing electric field (simultaneous development and cleaning), and a part of the toner deposited on the image portion (light portion) is used for the next image formation (Embodiment 2)

This embodiment is different from Embodiment 1 in the following two points. The other structures are the same, and therefore, the description thereof is omitted for simplicity.

(1) In place of the magnetic particle stirring member, the use is made with a blade plate rotation shaft 27 including a plurality of oval rings 27*a* (oval blade plate) arranged along and on a shaft 27*b* wherein the planes of the rings are inclined relative to the sleeve 21 as the magnetic brush carrying member. More particularly, the planes of the rings 27*a* crosses with a plane perpendicular to the longitudinal direction of the sleeve 21.

Figure 9:
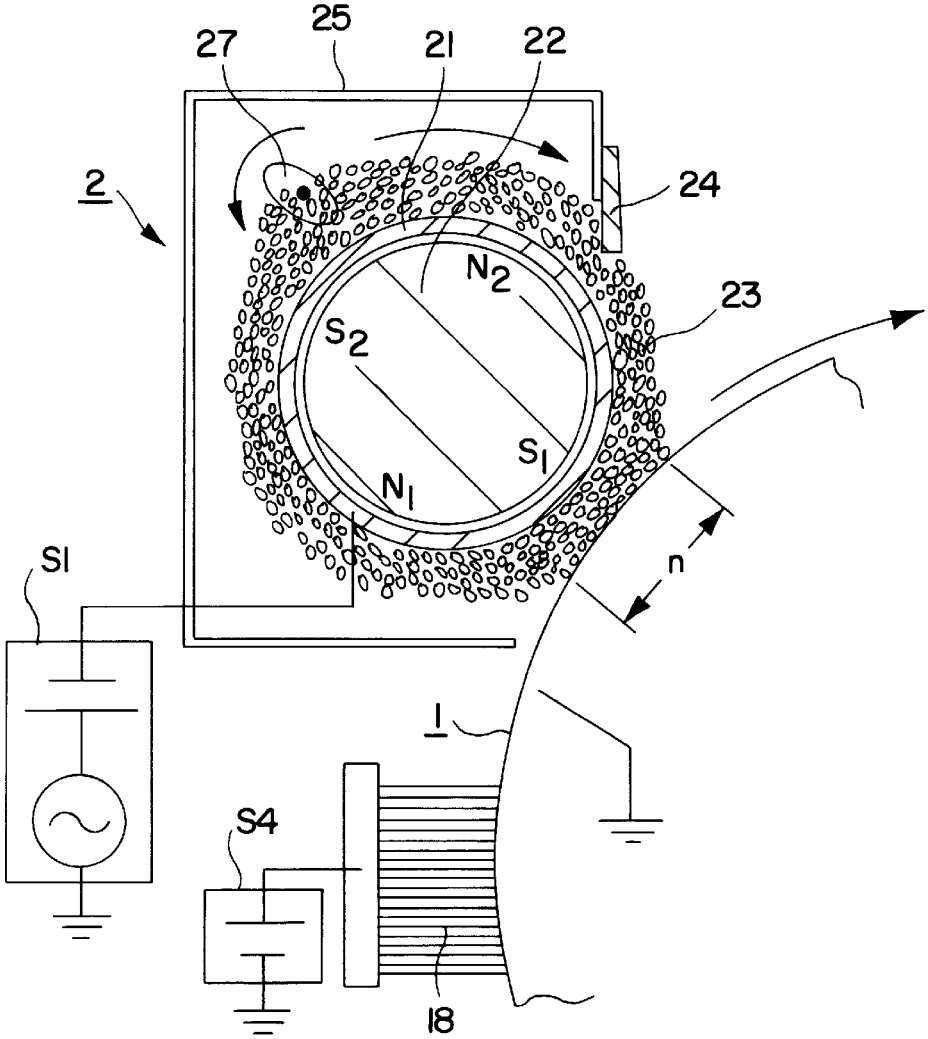
FIG. 9 is a schematic view of a major part (charging device portion) of an image forming apparatus according to Embodiment 2.
Figure 10:
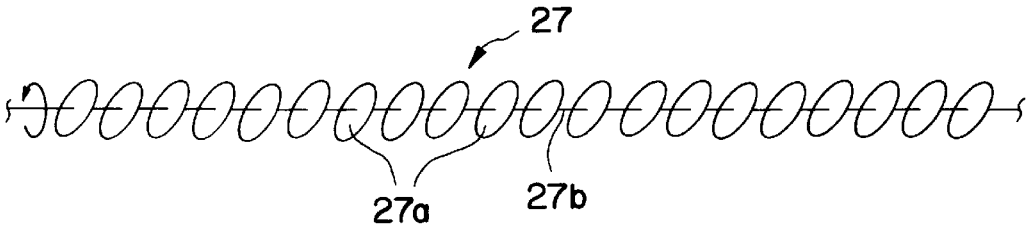
FIG. 10 is a perspective view of a magnetic particle stirring member of a magnetic brush portion.

(2) In place of the metal plate 17, a brush member 18 of electroconductive fiber as shown in FIG. 9 is used. The blade plate rotation shaft 27 as the magnetic particle stirring member is disposed close to the sleeve 21 in the apparatus casing 25 substantially parallel therewith, and the opposite end portions are rotatably supported by rear and front plates of the apparatus casing 25, wherein all the rings are in the magnetic brush portion 23. The blade plate rotation shaft 27 is rotated by an unshown driving mechanism in the counterclockwise direction indicated by an arrow in FIG. 9. The oval rings 27*a* are mounted to the shaft 27*b* at regular intervals and at the angle of 45°. By the rotation of the blade plate rotation shaft 27, the magnetic particles in the magnetic brush portion 23 reciprocate at least within the size width of the ring 27*a* and therefore are stirred in the longitudinal direction of the sleeve.

Therefore, even when a localized image is formed, the untransferred toner introduced in the magnetic brush portion 23 is stirred in the longitudinal direction of the sleeve 21 and dispersed, so that excessive local toner contamination of the magnetic brush portion 23 and the local potential decrease are prevented.

The brush member 18 is of brush member of electroconductive rayon having a fiber length of 6 mm, and the fibers are contacted to the surface of the photosensitive drum 1 between the transfer portion T and the charging nip n. The contact nip width between the photosensitive drum 1 and the contact nip is 7 mm. The brush member 18 is supplied with a DC voltage of +500V (opposite from the regular charge polarity of the toner) from the voltage source S4.

The untransferred toner on the rotatable photosensitive drum 1 is contacted to the brush portion of the brush member 18. Since the brush member 18 is supplied with the positive bias voltage, the untransferred toner of the negative is temporarily caught into the brush portion, and is discharged to photosensitive drum 1 after being electrically discharged. The untransferred toner having reached the charging nip n is either the one having the positive polarity or the one having low charge amount because of the discharging, so that it is easily collected by the magnetic brush portion 23.

The collected toner is charged to the negative polarity by the contact friction with the magnetic particles in the magnetic brush portion 23, and is uniformly discharged onto the photosensitive drum 1, and then is collected (simultaneous development and cleaning) by the developing device 4.

With such a structure, the image forming durability test was carried out, and it was confirmed that magnetic brush portion 23 continued the collection and discharge of the untransferred toner, without the excessive local toner contamination or deterioration of the charging power, so that good images were formed with stability for 100000 image formations.

(Embodiment 3)

This embodiment includes the following modifications from Embodiment 1 or 2. The other structures are the same, and therefore, the description thereof is omitted for simplicity.

(1) Toner particle t: spherical toner particle having an average particle size of 6 $\mu$m produced through a ??? polymerization method to which 1% by wt. Of titanium oxide having an average particle size of 20 $\mu$m is externally added (rather than pulverization as in Embodiments 1 and 2). Carrier c:

magnetic carrier having an average particle size of 35 $\mu$m and saturation magnetization of 205 emu/cm$^3$. The toner and carrier were mixed at weight ratio of 7:93.

(2) in this embodiment, a means is provided to remove and circulate the magnetic brush portion 23 of the magnetic particles from the sleeve 21 as the magnetic brush carrying member. More particularly, the magnetic particles are carried on the sleeve 21 and are supported in the apparatus, and the magnetic particles supported in the apparatus are exchanged with the magnetic particles carried on the sleeve 21. The magnet roller 22 as the magnetic field generating member for confining magnetically the magnetic brush portion 23 of the magnetic particles on the sleeve 21, has adjacent magnetic poles of the same polarity.

The magnetic particle stirring member is the same as the blade plate rotation shaft 27 in Embodiment 2.

Since the toner produced through the polymerization method is close to spherical shape, the externally added materials are uniformly applied. Therefore, the parting property relative to the photosensitive drum 1 is very good. For example, the comparison in the transfer efficiency ((toner amount per unit area on the transfer paper after the transfer)/(toner amount per unit area of the photosensitive drum) between the pulverized toner and the polymerized toner is such that it is 90% with the pulverized toner, and it is 97% with the polymerized toner). The fog is better with the polymerized toner than with the pulverized toner to such an extent that fog is prevention d even with Vback=50V when the polymerized toner is used.

In this embodiment, the amount of the untransferred toner is very small, and the parting property is good, and therefore, when it is used with the cleanerless system, the collection property is good without image defect.

Because of the high transfer efficiency, it is considered that regularly charged toner is substantially completely transferred, and the untransferred toner is mostly charged to the opposite polarity so that toner is collected by the magnetic brush portion 23 very efficiently. Additionally, since the parting property, relative to the magnetic particle, of the toner introduced into the magnetic brush portion 23 is so good that toner discharge from the magnetic brush portion 23 is better than with the pulverized toner.

Figure 11:
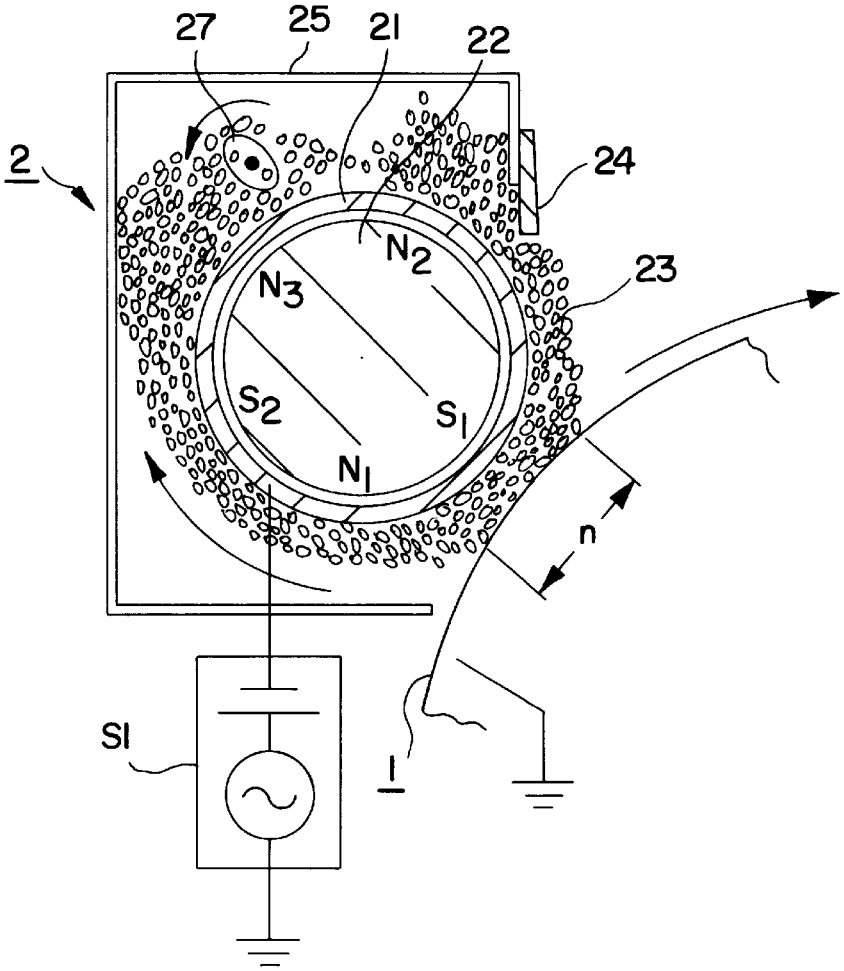
FIG. 11 is a schematic view of a major part (charging device portion) of an image forming apparatus according to Embodiment 3.
Figure 12:
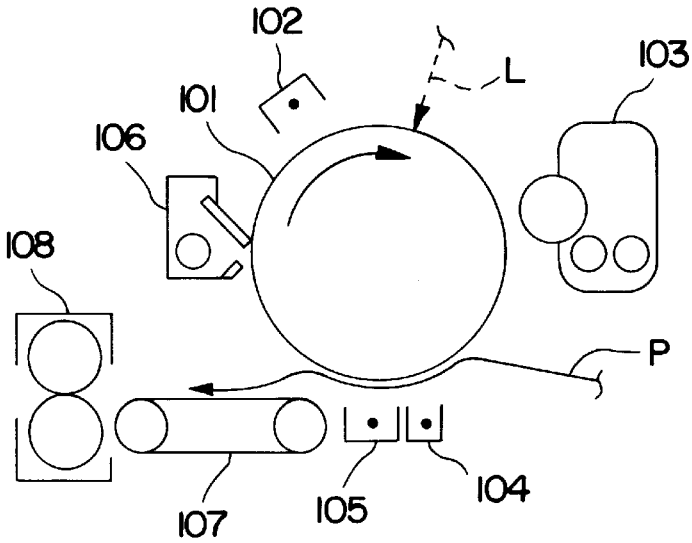
FIG. 12 is a schematic view of an example of a transfer type electrophotographic apparatus as a conventional image forming apparatus.

FIG. 11 is a sectional view including the sleeve pole disposition of the charging device 2 used in this embodiment.

Charging device 2 comprises a charging container (apparatus casing) 25, a sleeve 21 and a stirring member 27. A magnet roller 22 is encloses with the sleeve 21. Above the S1 pole of the magnet roller 22, a regulating blade 24 is provided with a gap of 800 $\mu$m from the sleeve 21 to provide thin layer coating of the magnetic particles, stagnated at the charging container side of the regulating blade 24, on the sleeve 21.

The charging is possible with the structure wherein just one full turn of magnetic particles are applied without using the regulating blade. However, by a larger amount being carried in the charging container 25 and applying them with the regulating blade 24, the amount of the coating is maintained even if a small amount of the magnetic particles are leaked out, so that charging nip n which is a contact portion between the magnetic brush portion 23 of the magnetic particles and the photosensitive drum 1 is a table. In the case of the cleanerless image forming apparatus as in this embodiment, the untransferred toner enters the magnetic brush portion 23, and therefore, the magnetic particles are contaminated by the toner. The degree of contamination decreases with increase of the amount of the magnetic particles. However, the contamination of the magnetic particles with the toner results from the shear (mechanical load (pressure) to the magnetic particle) in the magnetic particle stagnation upstream of the regulating blade 24, and therefore, the increase of the amount of the magnetic particle results in the increase of the amount in the magnetic particle stagnation and the increase of the shear.

Then, the magnetic particles are removed from the sleeve 21 and retained in the charging container 25. The magnetic particles in the charging container 25 are exchanged with the magnetic particles on the sleeve 21, by which the amount of the magnetic particle can be increased without increasing the amount of the stagnation upstream of the regulating blade.

In this embodiment, the magnetic particles are scraped off the sleeve 21 by the same polarity magnetic poles N3, N2 which are adjacent to each other in the charging container 25. The sleeve 21 rotates in the clockwise direction indicated by an arrow, and the magnetic brush portion 23 is contacted with the photosensitive drum 1 at the charging nip n to which the S1 pole is opposed, so that charging is effected.

The magnetic brush portion 23 of the magnetic particles having passed through the charging nip n is passed by the feeding poles N1, S2, and the magnetic brush portion 23 is removed from the sleeve 21 by the repelling poles constituted by the N3 pole and the N2 pole of the same polarity, opposed in the charging container. The magnetic particles thus removed are stirred by the stirring member 27, and are carried again an the sleeve 21 by the magnetic force of the N2 pole. Therefore, the stagnated magnetic particles are circulated, so that deterioration of a particular part of the magnetic particles can be prevented.

As regards the magnetic particle movement in the longitudinal direction of the sleeve for local deterioration prevention of the magnetic brush portion of the magnetic particles, the magnetic particles are stirred at the position where no confining force is applied to the magnetic particles toward the sleeve 21, and therefore, the stirring property is so good that introduced untransferred toner due to the high density image can be dispersed to the entire magnetic particles quickly.

With such a structure, the image forming durability test was carried out, and it was confirmed that magnetic brush portion 23 continued the collection and discharge of the untransferred toner, without the excessive local toner contamination or deterioration of the charging power, so that good images were formed with stability for 100000 image formations.

Embodiments 1, 2 and 3 may be combined.

(Others)

1) In a charging device of the magnetic brush type, the magnetic field generating member is enclosed in the magnetic brush carrying member, and the magnetic brush portion of the electroconductive magnetic particles are magnetically confined on the outer surface of the magnetic brush carrying member by the magnetic field produced by the magnetic field generating member, and the magnetic brush portion may be circulated by rotation of the magnetic field generating member.

In the foregoing embodiment, the sleeve is rotated and the magnet roller is stationary, but the sleeve may be stationary while the magnet roller is rotated, or both may be rotated.

2) Member to be charged or the image bearing member as the member to be charged is provided with a layer of a material having a volume resistivity of $10^9$–$10^{14}$ Ωcm, by which the contact injection charging is dominant.

Even when the charge injection layer is not used, the equivalent effects are provided if the charge transfer layer has such a resistance. The equivalent effects are provided when the image bearing member is of amorphous silicon or selenium surface layer.

The charging for the member to be charged may be effected by the contact charging type in which discharge phenomenon is dominant.

3) The waveform of the alternating voltage (AC voltage) component to be applied to the charging device or to the developing device, may be a sunisoidal wave, a rectangular wave, a triangular wave or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

4) In an image forming apparatus, the means for writing information on the charged surface of the photosensitive member (image bearing member) may use LED or another solid light emitting element, in place of the laser scanning means, closely disposed to the image bearing member, by which the light therefrom is used for the latent image formation. Halogen lamp, fluorescent lamp or the like (analog image exposure means) is usable, too. What is required is that electrostatic latent image is formed corresponding to the image information.

The image bearing member may be an electrostatic recording dielectric member or the like. In this case, the dielectric member surface is uniformly charged (primary charging) to a predetermined polarity and potential, and thereafter, it is selectively discharged by a discharging stylus head, an electron gun or another discharging means to write an intended electrostatic latent image.

5) Toner developing system means for the electrostatic latent image may be of any type. Reverse development type and regular developing system are equally usable.

6) The transferring means 6 is not limited to the belt transfer, but a roller transfer or corona discharge transfer are usable.

Using the transfer drum, transfer belt or another intermediary transfer member, a multi-color image or a full-color image in addition to the monochromatic image can be formed using superimposing transfer.

7) The transfer portion T and the charging nip n, the furbrush member 18 contacted to the untransferred toner may by a rotatable brush. A contact member other than the furbrush member is usable it is advantageous that contact member other than the furbrush member 18 or the furbrush member, is of such a material that it triboelectrically charges the toner to the polarity opposite from the regular polarity.

8) Two or more of the magnetic brush member in the charging device 2, the member 17 or 18 for charging the untransferred toner to the opposite polarity from the regular polarity or discharging it, may be provided in series in the surface movement direction of the image bearing member.

Member 17 or 18 may be omitted. The image forming apparatus may be provided with a cleaner exclusively for removing the untransferred toner from the image bearing member surface.

9) The image formation process of the image forming apparatus is not limited to those of the embodiments. Additional assisting process means are usable.

10) The charging device of the magnetic brush type according to this invention is not limited to the use for the charging means for the image bearing member in an image forming apparatus, but is usable for charging a member to be charged.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a magnetic brush charging member for being supplied with a voltage to electrically charge a member to be charged, said charging member including a magnetic particle layer contactable to the member to be charged and a carrying member for carrying the magnetic particle layer, wherein said magnetic particle layer is moved along a peripheral surface of said carrying member;

a container enclosing said magnetic brush charging member; and a projection extended from an inner side of said container into said magnetic particle layer.

2. An apparatus according to claim 1, wherein said carrying member is a rotatable member.

3. An apparatus according to claim 1, further comprising a rotatable magnetic field generating member inside said carrying member.

4. An apparatus according to claim 1, wherein a plurality of such said projections are provided and are arranged in a longitudinal direction of the carrying member at regular intervals.

5. An apparatus according to claim 1, wherein said projection has a portion where a width, measured in a longitudinal direction of said carrying member, of said projection expands toward downstream with respect to a movement direction of said magnetic particle layer along a peripheral surface of said carrying member.

6. An apparatus according to claim 1, further comprising a non-rotatable magnetic field generating member inside said carrying member, wherein a position of a most downstream portion of a portion where said projection is contacted to said magnetic particle layer is deviated from a position of a magnetic pole of said magnetic field generating member in a movement direction of said magnetic particle layer along a peripheral surface of said carrying member.

7. An apparatus according to claim 1, further comprising a non-rotatable magnetic field generating member inside said carrying member, and said magnetic field generating member is provided with adjacent magnetic poles having the same magnetic polarities.

8. An image forming apparatus comprising:

an image bearing member for bearing a toner image;

a magnetic brush charging member for being supplied with a voltage to electrically charge said image bearing member, said charging member including a magnetic particle layer contactable to said image bearing member, and a carrying member for carrying the magnetic particle layer, wherein said magnetic particle layer is moved along a peripheral surface of said carrying member;

a container enclosing said magnetic brush charging member;

a projection extended from an inner side of said container into said magnetic particle layer; and developing means for developing with toner an electrostatic latent image formed on said image bearing member using charging operation of said charging member, said developing means is capable of removing residual toner from said image bearing member.

9. An apparatus according to claim 8, wherein said carrying member is a rotatable member.

10. An apparatus according to claim 8, further comprising a rotatable magnetic field generating member inside said carrying member.

11. An apparatus according to claim 8, wherein a plurality of such said projections are provided and are arranged in a longitudinal direction of the carrying member at regular intervals.

12. An apparatus according to claim 8, wherein said projection has a portion where a width, measured in a longitudinal direction of said carrying member, of said projection expands toward downstream with respect to a movement direction of said magnetic particle layer along a peripheral surface of said carrying member.

13. An apparatus according to claim 8, further comprising a non-rotatable magnetic field generating member inside said carrying member, wherein a position of a most downstream portion of a portion where said projection is contacted to said magnetic particle layer is deviated from a position of a magnetic pole of said magnetic field generating member in a movement direction of said magnetic particle layer along a peripheral surface of said carrying member.

14. An apparatus according to claim 8, further comprising a non-rotatable magnetic field generating member inside said carrying member, and said magnetic field generating member is provided with adjacent magnetic poles having the same magnetic polarities.

15. An apparatus according to any one of claims 8, 9, 10, 11, 12, 13 and 14, wherein said developing means capable of effecting a developing operation and a cleaning operation simultaneously.

16. An apparatus according to claim 8, wherein said image bearing member has a surface layer having a volume resistivity of $10^9$–$10^{14}$ Ωcm.

17. An apparatus according to claim 16, wherein said image bearing member is provided with an electrophotographic photosensitive layer inside said surface layer.

* * * * *

UNITED STATES PATENT AND TRADEMARK OFFICE

CERTIFICATE OF CORRECTION

PATENT NO. : 6,163,670
DATED : December 19, 2000
INVENTOR(S) : Fumiteru Gomi et al.

It is certified that error appears in the above-identified patent and that said Letters Patent is hereby corrected as shown below:

Column 1,
Line 13, "electraphotographic" should read -- electrophotographic --.

Column 2,
Line 8, "masher" should read -- member --;
Line 11, "( (magnetic" should read -- (magnetic --;
Line 12, "charger) )," should read -- charger), --; and
Lines 61-67, left margin should be closed up.

Column 3,
Lines 30-35, left margin should be closed up; and
Line 44, "results" should read -- result --.

Column 5,
Line 20, "structure" should read -- structure of --;
Line 32, "Charged" should read -- charged --; and
Line 58, "the" should be deleted.

Column 6,
Line 5, "it." should read "i t.;
Line 36, "electraphotographic" should read -- electrophotographic --; and
Line 67, "is," should read -- is --.

Column 8,
Line 53, "an" should read -- on --.

Column 9,
Line 16, "23" should read -- 25 --;
Line 31, "at" should read -- of --;
Line 41, "$V_f$" should read -- $V_f$ of --; and
Line 53, "ing" should read -- ing to --.

Column 10,
Line 26, "particles," should read -- particles --.

Column 13,
Line 26, "Of" should read -- of --; and
Line 58, "ia" should read -- is --.

UNITED STATES PATENT AND TRADEMARK OFFICE

CERTIFICATE OF CORRECTION

PATENT NO. : 6,163,670
DATED : December 19, 2000
INVENTOR(S) : Fumiteru Gomi et al.

It is certified that error appears in the above-identified patent and that said Letters Patent is hereby corrected as shown below:

Column 14,
Line 8, "includes" should read -- include --;
Line 11, polyethylenenaphthalate," should read -- polyethylenenaphthalate --;
Line 19, "length of" (second occurrence) should be deleted;
Line 46, "difficulty," should read -- difficult, --.

Column 16,
Line 10, "extend" should read -- extent --;
Line 32, "require" should read -- required --;
Line 53, "100000" should read -- 100,000 --; and
Line 67, "formation" should read -- formation, --.

Column 17,
Line 11, "crosses" should read -- cross --; and
Line 66, "100000" should read -- 100,000 --.

Column 18,
Line 8, "Of" should read -- of --; and
Line 59, "encloses" should read -- enclosed --.

Column 19,
Line 57, "100000" should read -- 100,000 --.

Column 20,
Lines 50-51, the left margin should be indented;
Line 62, "by" should read -- be --; and
Line 63, "usable it" should read -- usable. It --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*